United States Patent [19]

Haggard

[11] 4,447,104

[45] May 8, 1984

[54] APPARATUS FOR ATTACHING A MULTICONDUCTOR CABLE TO A HOUSING

[75] Inventor: Samuel E. Haggard, Houston, Tex.

[73] Assignee: Mark Products, Inc., Houston, Tex.

[21] Appl. No.: 340,228

[22] Filed: Jan. 18, 1982

[51] Int. Cl.[3] ..... H01R 13/58

[52] U.S. Cl. ..... 339/103 M; 339/94 M

[58] Field of Search ..... 339/103

[56] References Cited

U.S. PATENT DOCUMENTS

| | | | |
|---|---|---|---|
| 3,614,298 | 10/1971 | Thompson et al. | 339/103 R |
| 3,880,490 | 4/1975 | Belmont | 339/103 B |
| 4,295,005 | 10/1981 | Daugherty et al. | 339/103 C |

*Primary Examiner*—Joseph H. McGlynn
*Assistant Examiner*—David L. Pirlot
*Attorney, Agent, or Firm*—Vaden, Eickenroht, Thompson, Bednar & Jamison

[57] ABSTRACT

Apparatus for attaching a multiconductor cable to a housing, such as the backshell of a connector, is disclosed that has a seal member located in the opening in the tubular section of the housing through which the cable extends into the housing to seal the space between the cable and the walls of the opening. A clamp is attached to the cable adjacent to the end of the tubular section. Washers are located on each side of the clamp and held in engagement with the clamp and the housing by a gland nut so that any forces imposed on the cable outside the housing will be transmitted to the housing by the clamp, the washers, and the gland nut and not be imposed on the section of cable in engagement with the seal member.

5 Claims, 7 Drawing Figures

FIG. 1
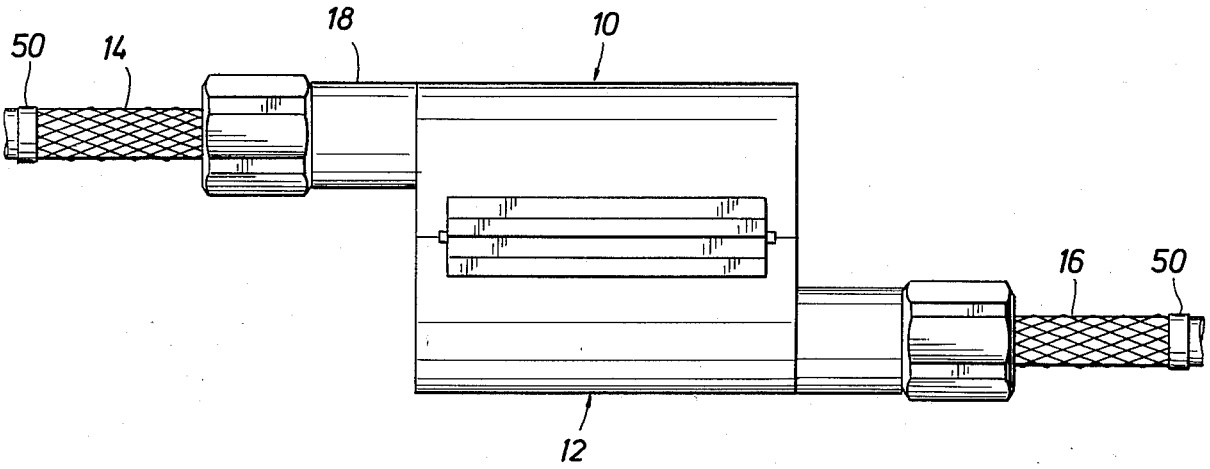
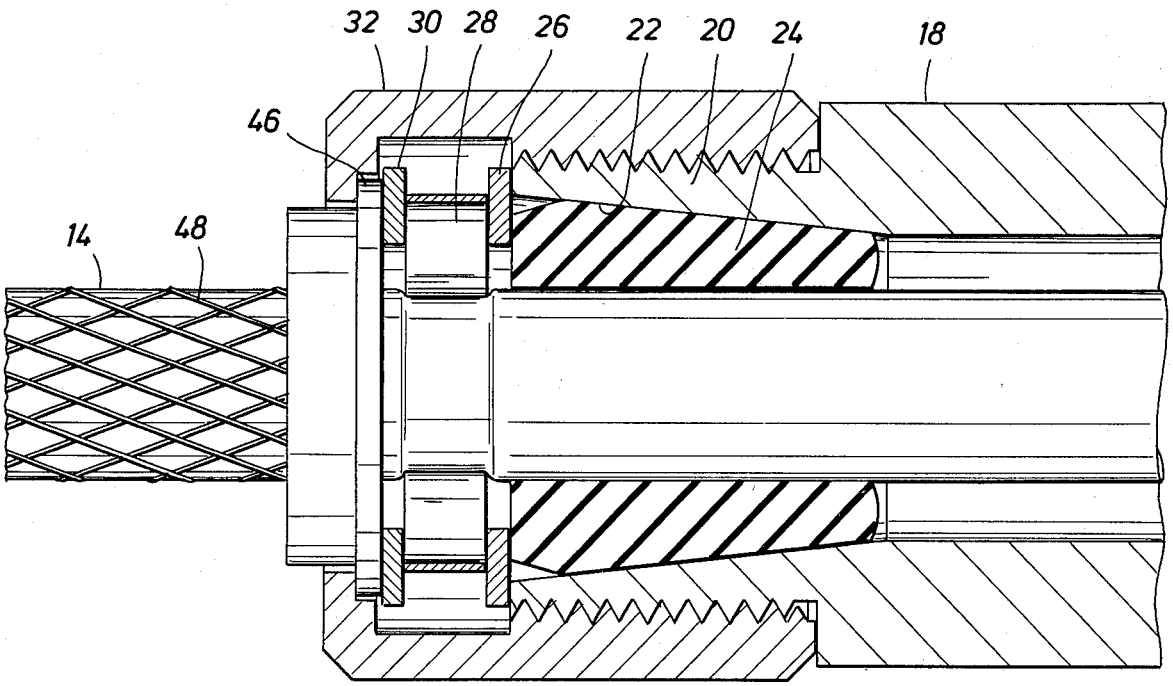
FIG. 2

FIG. 3
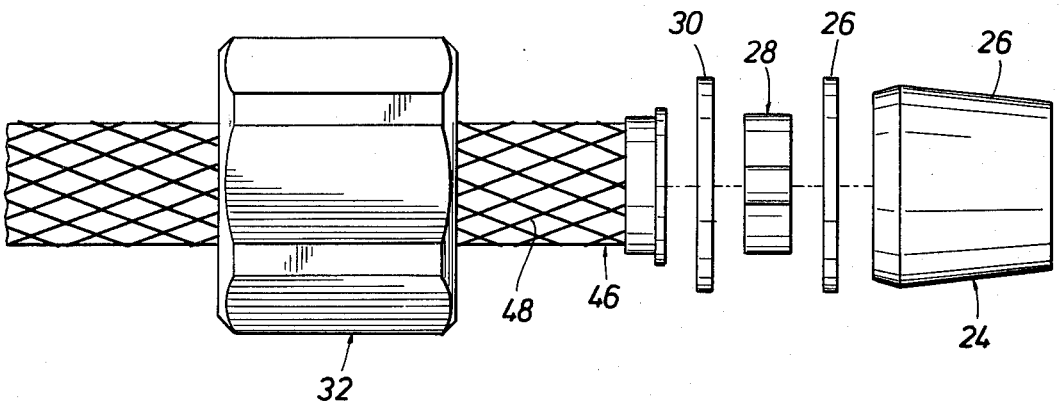
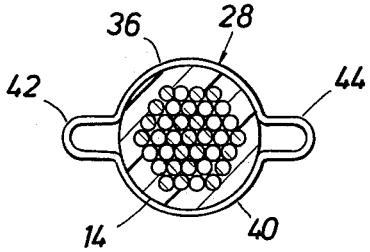
FIG. 4A
FIG. 4B
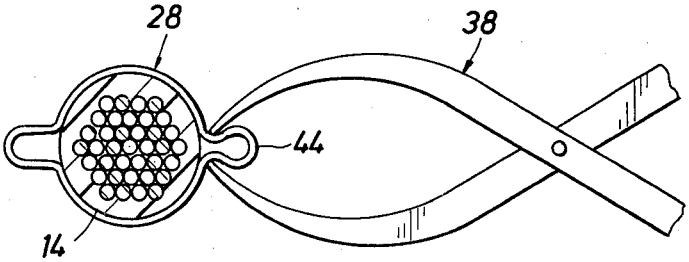
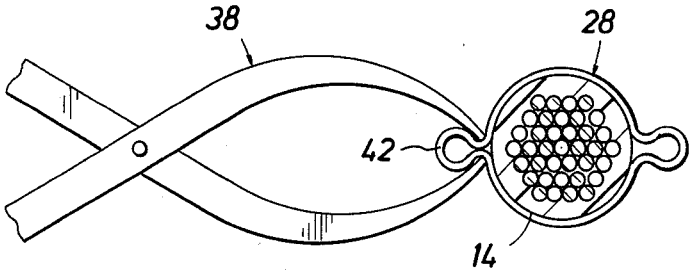
FIG. 4C
FIG. 4D
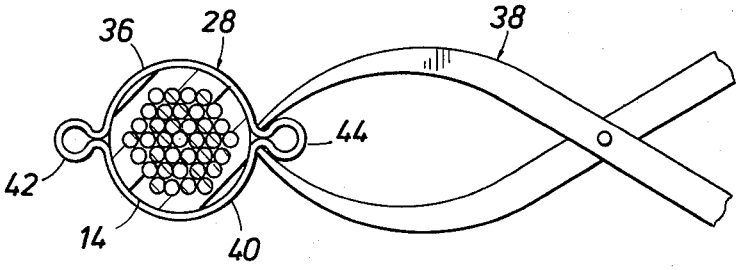

APPARATUS FOR ATTACHING A MULTICONDUCTOR CABLE TO A HOUSING

This invention relates to apparatus for attaching a multoconductor cable to a housing.

This invention is useful for attaching a multiconductor cable to any housing, but it has particular utility where a waterproof connection is required and the cable is subjected to longitudinal forces tending to push it in or pull it out of the housing. For example, the connection between the multiconductor cable and the back shell of an electrical connector that is to be used in a marine environment must be water proof and is subjected to forces tending to pull the cable out of the backshell.

Such a marine connector is described in U.S. Pat. No. 4,249,788, entitled "Waterproof Multiple Wire Cable Connecting Device," which issued on Feb. 10, 1981. This patent also shows a typical prior art arrangement for attaching a multiconductor cable to the backshell of the connector and for providing a seal between the cable and the backshell. In such prior art devices, a tubular sleeve of elastomeric material, such as rubber, is wedged into a tapered cavity in the opening through which the cable enters the backshell to compress the elastomeric sleeve into sealing engagement with the outside of the cable and the inside of the tapered cavity of the backshell. It is the common practice, however, to pick up these connectors, or the half of the connector attached to the cable, by using the cable extending out of the backshell as a handle. This places tension in the outer sheath of the cable that is in engagement with the elastomeric sleeve, since the full weight of the connector is supported by the frictional forces developed between the sleeve and the outer sheath of the cable. This tension in the outer sheath, which is usually an extruded plastic material, causes the outside diameter of the sheath to be reduced. In other words, it necks down due to the tensile load and may or may not return to its original diameter when the load is relieved. When this occurs over a period of time, the seal between the sleeve of elastomeric material and the outer sheath of the cable is less and less effective and may, in time, allow moisture to leak into the backshell of the connector.

It is an object of this invention to provide apparatus for attaching a multiconductor cable to a housing, such as the backshell of a connector, that relieves the section of the cable in sealing engagement with the compressed elastomeric sleeve from any tensile forces on the cable, such as when the connector is picked up by the cable.

It is another object of this invention to provide such apparatus that will also prevent any compressive loads from being exerted on the section of the cable in engagement with the sealing element used to provide the seal between the cable and the housing.

It is another object of this invention to provide such apparatus that includes a woven gripper that is actuated when the cable is used to pick up the connector to transmit a portion of the load of the connector directly to the housing.

These and other objects, advantages, and features of this invention will be apparent to those skilled in the art from a consideration of this specification, including the attached drawings and appended claims.

In the drawings:

FIG. 1 is a side view, in elevation, of an assembled multiconductor electrical connector of the type described in the above-identified patent;

FIG. 2 is a sectional view through the portion of the backshell of one of the connector halves shown in FIG. 1, through which the multiconductor cable extends into the backshell, showing the assembled apparatus of this invention;

FIG. 3 is an exploded view of the apparatus of this invention used to connect a multiconductor cable to the housing; and FIGS. 4A–14D are cross-sectional views showing how the hose clamp employed in this invention is attached to the cable.

In FIG. 1, connector 10 is mated with connector 12 to connect electrically the multiconductors of cables 14 and 16. For a complete description of this connector, refer to the above-identified patent.

The sectional view shown in FIG. 2 is taken through tubular section 18 of backshell 10 through which cable 14 enters the backshell and shows the preferred embodiment of the apparatus of this invention that attaches the cable to the backshell.

The outer surface of tubular section 18 is provided with male threads 20. The opening through the tubular section has section 22 that tapers inwardly at an angle of approximately 6°. A seal member is located between the wall of tubular section 18 and cable 14 to keep moisture from entering the backshell. In the embodiment shown, the seal member is body 24 of elastomeric material, which is compressed between the cable and tapered section 22. The means for compressing body 24 into sealing engagement with the cable and tapered surface will be described below.

In accordance with this invention, means are provided to transmit any longitudinal force on the cable outside the housing to the housing to keep the force from being exerted on the section of the cable in sealing engagement with the seal ring. In the embodiment shown, hose clamp 28 is attached to cable 14 in the manner shown in FIGS. 4A–4D. The clamp incudes two circular portions 36 and 40 that encircle cable 14 and are connected together by outwardly extending U-shaped sections 42 and 44. To attach the clamp to the cable, U-shaped section 44 is partially crimped by pliers 38, as shown in FIG. 4B. Next, opposite U-shaped section 42 is crimped to the maximum extent, as shown in FIG. 4C. Then, U-shaped section 36 is completely crimped, as shown in FIG. 4D, which causes circular sections 36 and 40 to grip the outer sheath of cable 14 sufficiently to prevent relative movement between the two.

Washer 26 is positioned between clamp 28 and the end of tubular section 18 to transmit any force urging the cable into the backshell from the clamp to the backshell. Washer 30 is positioned on the opposite side of clamp 28. Gland nut 32 has female threads to engage the male threads on tubular member 18 and an inwardly extending flange that engages flange 46 to hold clamp 28 and washer 30 from movement away from the backshell. Thus, any force on the cable tending to pull the cable out of the backshell is transmitted to the housing through the clamp, washer 30, flange 46, and gland nut 32, and the section of the cable in engagement with the seal member is relieved of any such force.

Gland nut 32 also provides the force necessary to compress body 24 of elastomeric material into sealing engagement with the cable and bore 22 as the threaded connection between the nut and the backshell is tightened.

It is another feature of this invention to provide means for transferring a portion of any tensile load imposed on the cable directly to gland nut 32 when the cable is used as a handle to pick up the connector. Such means includes flange 46 to which is connected one end of mesh gripper 36. The other end of the mesh is attached to the outer sheath of the cable by tape 38 after the mesh has been pulled into gripping engagement with the cable. This particular mesh is designed to grip the surface of cable 14 and prevent any relative movement between the outer sheath of the cable and the mesh whenever any tensile load is placed on the ouer sheath of the cable. Any load placed in the mesh is transmitted to flange 34, and, in turn, through gland nut 32 to tubular section 18 of the outer shell. The wire mesh may not immediately take over some of the load when the connector is picked up by the cable, since it may take some relative movement before that happens. Therefore, the initial tensile load placed on the outer sheath of the cable is usually transmitted to hose clamp 28 in the manner described above.

From the foregoing, it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

As many possible embodiments may be made of this invention without departing from the scope thereof, it is to be understood that all matter herein set forth or shown in the accompanying drawings is to be interpreted as illustrative and not in a limiting sense.

The invention having been described, what is claimed is:

1. Apparatus for attaching a multiconductor cable to a housing, such as the backshell of a connector, comprising a housing having an opening through which the cable extends into the housing, a seal member surrounding the cable and located in the opening to seal the space between the cable and the housing, means attached to the cable to transmit to the housing any longitudinal forces imposed on the cable to keep said forces from reaching that portion of the cable in sealing engagement with the seal member, said means including clamp means attached to the cable between the seal ring and the cable outside the housing, and means including a washer located between the clamp means and the housing, a washer on the other side of the clamp means, and a nut having a threaded connection with the housing for holding the washers in engagement with the clamp means, the housing, and the nut, for transmitting any forces imposed on the cable from the clamp means to the housing.

2. The apparatus of claim 1 further provided with a mesh gripper connected to the nut and covering a portion of the cable extending from the nut to transmit tensile forces imposed on the cable to the nut and the housing.

3. Apparatus for attaching a multiconductor cable to a housing, such as the backshell of a connector, comprising a housing having an opening through which the cable extends into the housing, said opening having an inwardly tapering section, a seal member surrounding the cable and wedged in the tapered section of the opening to form a seal between the cable and the housing, a clamp clamped to the cable sufficiently to prevent relative movement between the clamp and the cable, means for transmitting from the clamp to the housing any force urging the cable into the housing, and means attached to the housing for exerting a force on the seal member to compress the seal member between the cable and the tapered section of the opening in the housing and to transmit any forces imposed on the cable to the housing so that the portion of the cable in sealing engagement with the seal member is relieved of such forces.

4. The apparatus of claim 3 in which the means for transmitting from the clamp to the housing any force on the cable urging the cable into the housing comprises a washer located between and in engagement with the end of the housing and the clamp.

5. The apparatus of claim 4 in which the means attached to the housing for exerting a force on the seal member to compress the seal member between the cable and the tapered section of the opening in the housing and to transmit any forces imposed in the cable tending to pull the cable out of the housing from the clamp to the housing comprises a gland nut in threaded engagement with the housing and in engagement with the clamp to compress the seal member in the threaded connection between the nut and the housing is tightened until the means for transmitting from the clamp to the housing any force urging the cable into the housing stops further movement of the clamp and the gland nut toward the housing.

* * * * *